US008618449B2

(12) United States Patent
Kim

(10) Patent No.: US 8,618,449 B2
(45) Date of Patent: Dec. 31, 2013

(54) METHOD AND APPARATUS FOR CONTROLLING PHASE OF AC POWER AND METHOD OF CONTROLLING HEATING ELEMENT OF FIXING UNIT

(75) Inventor: Se-joong Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1651 days.

(21) Appl. No.: 12/041,093

(22) Filed: Mar. 3, 2008

(65) Prior Publication Data

US 2008/0296280 A1 Dec. 4, 2008

(30) Foreign Application Priority Data

May 28, 2007 (KR) ..... 2007-0051587

(51) Int. Cl.
*H05B 1/02* (2006.01)

(52) U.S. Cl.
USPC ..... 219/492; 219/481; 219/497; 219/501

(58) Field of Classification Search
USPC ..... 219/216, 481, 490, 492, 497, 499, 201, 219/505, 508; 399/67, 69
See application file for complete search history.

(56) References Cited

U.S. PATENT DOCUMENTS

| | | | | |
|---|---|---|---|---|
| 5,669,038 | A | 9/1997 | Kishimoto | |
| 5,966,562 | A * | 10/1999 | Maehara | 399/69 |
| 2003/0178410 | A1 * | 9/2003 | Satoh | 219/494 |
| 2004/0129694 | A1 * | 7/2004 | Ishii | 219/492 |

FOREIGN PATENT DOCUMENTS

| | | |
|---|---|---|
| JP | 9-16018 | 1/1997 |
| JP | 2004-79257 | 3/2004 |
| JP | 2004-146366 | 5/2004 |

* cited by examiner

*Primary Examiner* — Brian Jennison
(74) *Attorney, Agent, or Firm* — Staas & Halsey LLP

(57) ABSTRACT

A method of controlling a phase of an alternating current (AC) power having an AC voltage waveform having a predetermined cycle includes counting a number of times a zero crossing signal has been generated, the zero crossing signal being generated whenever a level of the AC voltage waveform becomes "0"; calculating a half cycle of the AC voltage waveform based on times at which the counted number of times the zero crossing signal has been generated changes; detecting phases that divide an area surrounded by a waveform corresponding to the half cycle of the AC voltage waveform into a predetermined number of equal areas; and generating control pulse signals based on the detected phases.

14 Claims, 5 Drawing Sheets

METHOD AND APPARATUS FOR CONTROLLING PHASE OF AC POWER AND METHOD OF CONTROLLING HEATING ELEMENT OF FIXING UNIT

CROSS-REFERENCE TO RELATED APPLICATIONS

This application claims the benefit of Korean Patent Application No. 2007-51587 filed on May 28, 2007, in the Korean Intellectual Property Office, the disclosure of which is incorporated herein by reference in its entirety.

BACKGROUND OF THE INVENTION

1. Field of the Invention

Aspects of the invention relate to a method of and an apparatus for controlling the phase of an alternating current (AC) power provided to a fixing unit, and a method of controlling a heating element of the fixing unit.

2. Description of the Related Art

An electrophotographic image forming apparatus, such as a printer, a copier, a facsimile machine, or a multifunctional product, is typically provided with a photosensitive medium, a development unit, a transfer unit, and a fixing unit. The transfer unit is an apparatus for transferring an image formed on the photosensitive medium by the development unit with a developer onto a recording paper. The fixing unit is an apparatus for fixing the image transferred onto the recording paper. In a typical fixing unit, a fixing roller is provided separately from a transfer roller that feeds the recording paper so that the recording paper fed by the transfer roller can be pressed and moved forward. The surface of the fixing roller can be heated to a predetermined temperature using a heating element, such as a halogen lamp. Halogen lamps are inexpensive, and the method of controlling a halogen lamp is simple. Thus, halogen lamps are widely used as the heating elements of fixing units. However, since the resistance of a halogen lamp itself is low, a high current is input to the halogen lamp when it is first turned on, and when a large amount of power is required, an input voltage is distorted and a flicker phenomenon occurs. Accordingly, to solve these problems, a phase of an alternating current (AC) power provided to a fixing unit is controlled.

FIGS. 1A through 1D are graphs of phase control characteristics of an AC power provided to a typical fixing unit. In general, if an AC power is provided to a fixing unit, a phase control apparatus is used to control the phase of the provided AC power and thereby control the heating time of a heating element that heats the fixing unit. The phase control apparatus divides a waveform corresponding to a half cycle of a waveform of the AC power provided to the fixing unit into equal time intervals, and generates a control pulse signal for each of the equal time intervals. Then, the generated control pulse signals are sequentially provided to the heating element of the fixing unit so that the heating time of the heating element can be controlled.

Referring to FIG. 1A, if five waveforms 100, 110, 120, 130, and 140 each corresponding to a half cycle of an AC power waveform are sequentially provided to a fixing unit, the phase control apparatus divides waveform 100 corresponding to a half cycle of the AC power waveform into five equal time intervals (T1). Then, by providing a control pulse signal generated in each of the five equal time intervals (T1) to the fixing unit, an on or off time of the AC power provided to a heating element is controlled. That is, by using the control pulse signal, the conducting time of a current provided to the heating element of the fixing unit can be adjusted.

When the time interval obtained by dividing the waveform corresponding to the half cycle of the AC power waveform into equal time intervals is T1 as shown in FIG. 1A, if the first waveform 100 corresponding to the half cycle of the AC power waveform is provided to the heating element of the fixing unit and supply of a current to the heating element begins, a control pulse signal 102 is provided at a time T1 later so that a current stops flowing through the heating element. Accordingly, after the AC power is supplied to the heating element of the fixing unit, the energy is supplied only for the time T1. Also, if the second waveform 110 corresponding to the half cycle of the AC power waveform is provided to the heating element, a control pulse signal 112 is provided at a time 2*T1 later so that energy can be supplied to the heating element only for a time 2*T1 time after the second waveform 110 is provided. That is, control pulse signals 102, 112, 122, 132, and 142 are provided to the fixing unit at the time points shown in FIG. 1B so that energy corresponding to the areas (A, B, C, D, E) of the waveform shown in FIG. 1C can be provided to the heating element of the fixing unit.

Thus, if control pulse signals generated at time points in which the changes in the time interval are uniform are provided to the fixing unit to adjust the time for supplying energy to the heating element, the accumulated energy provided to the heating element will have a waveform in which changes in the energy are not uniform as shown in FIG. 1D. For example, when the phase of the waveform corresponding to the half cycle of the AC power waveform is 90°, the energy supplied to the heating element shows rapid changes.

That is, in a typical phase control apparatus, the phase of the AC power supplied to the heating element of the fixing unit is controlled so that the change in the time interval can be uniform. Accordingly, the changes in the energy provided to the heating element are non-uniform. As a result, a distortion in the input voltage and a flicker phenomenon in which power provided to neighboring circuits momentarily flickers due to the non-uniform energy changes can occur, and therefore can badly affect the operation and stability of the neighboring circuits.

SUMMARY OF THE INVENTION

Aspects of the invention relate to a method of controlling a phase of an alternating current (AC) power, a method of controlling a heating element of a fixing unit, and an apparatus for controlling a phase of an AC power, in which a phase of AC power is controlled based on phases that divide a half cycle of an AC voltage waveform into a predetermined number of equal areas, thereby improving distortion of an input voltage and a flicker phenomenon caused by non-uniform energy changes.

According to an aspect of the invention, there is provided a method of controlling a phase of an alternating current (AC) power having an AC voltage waveform having a predetermined cycle, the method including counting a number of times a zero crossing signal has been generated, the zero crossing signal being generated whenever a level of the AC voltage waveform becomes "0"; calculating a half cycle of the AC voltage waveform based on times at which the counted number of times the zero crossing signal has been generated changes; detecting phases that divide an area surrounded by a waveform corresponding to the half cycle of the AC voltage waveform into a predetermined number of equal areas; and generating control pulse signals based on the detected phases.

According to an aspect of the invention, a computer-readable medium is encoded with a computer program for executing the above-described method of controlling a phase of an AC power with a computer.

According to an aspect of the invention, there is provided a method of controlling a heating element of a fixing unit, the method including counting a number of times a zero crossing signal has been generated, the zero crossing signal being generated whenever a level of an alternating current (AC) voltage waveform having a predetermined cycle becomes "0"; calculating a half cycle of the AC voltage waveform based on times at which the counted number of times the zero crossing signal has been generated; detecting phases that divide an area surrounded by a waveform corresponding to the half cycle of the AC voltage waveform into a predetermined number of equal areas; generating control pulse signals based on the detected phases; and controlling a conducting time of an AC power supplied to the heating element of the fixing unit using the generated control pulse signals.

According to an aspect of the invention, a computer readable medium is encoded with a computer program for executing the above-described method of controlling a heating element of a fixing unit with a computer.

According to an aspect of the invention, there is provided an apparatus for controlling a phase of an alternating current (AC) power having an AC voltage waveform having a predetermined cycle, the apparatus including a counter unit to count a number of times a zero crossing signal has been generated, the zero crossing signal being generated whenever a level of the AC voltage waveform becomes "0"; an operation unit to calculate a half cycle of the AC voltage waveform based on times at which the counted number of times the zero crossing signal has been generated changes; a phase detection unit to detect phases that divide an area surrounded by a waveform corresponding to the half cycle of the AC voltage waveform into a predetermined number of equal areas; and a control pulse signal generation unit to generate control pulse signals based on the detected phases.

Additional aspects and/or advantages of the invention will be set forth in part in the description that follows and, in part, will be obvious from the description, or may be learned by practice of the invention.

BRIEF DESCRIPTION OF THE DRAWINGS

The above and/or other aspects and advantages of the invention will become apparent and more readily appreciated from the following description of embodiments of the invention, taken in conjunction with the accompanying drawings of which.

DETAILED DESCRIPTION OF THE EMBODIMENTS

Figure 1A:
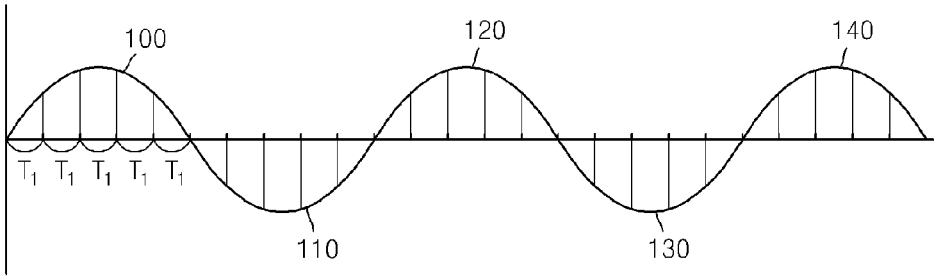
FIG. 1A (RELATED ART)
FIGS. 1A through 1D are graphs of phase control characteristics of an alternating current (AC) power provided to a typical fixing unit.
Figure 1B:
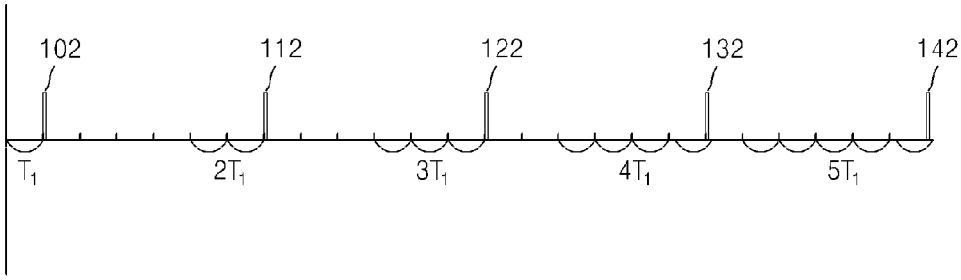
FIG. 1B (RELATED ART)
Figure 1C:
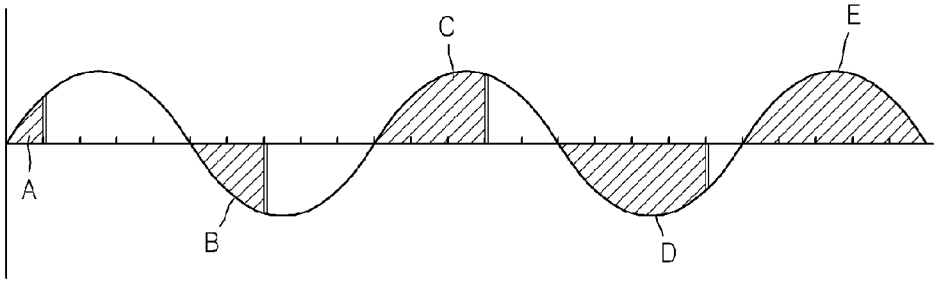
FIG. 1C (RELATED ART)
Figure 1D:
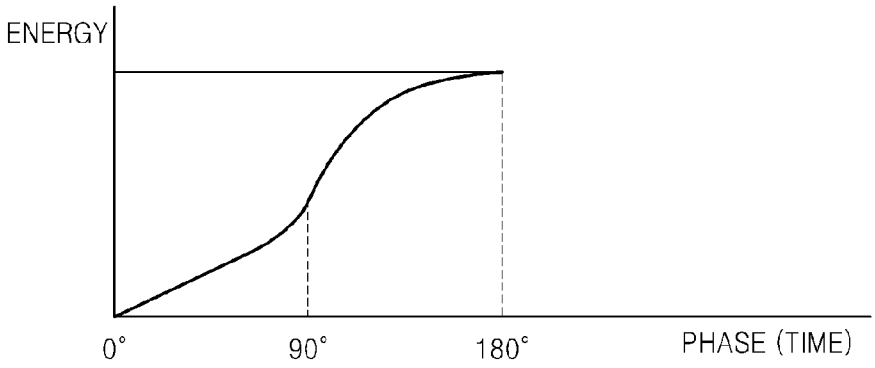
FIG. 1D (RELATED ART)

Reference will now be made in detail to embodiments of the invention, examples of which are shown in the accompanying drawings, wherein like reference numerals refer to like elements throughout. The embodiments are described below to explain the invention by referring to the figures.

Figure 2:
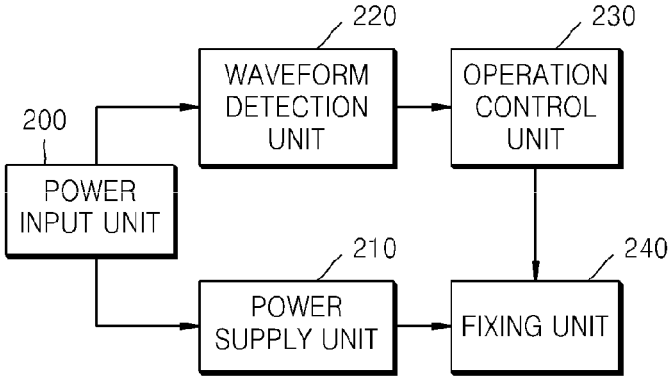
FIG. 2 is a block diagram of an apparatus for controlling a fixing unit according to an aspect of the invention.

FIG. 2 is a block diagram of an apparatus for controlling a fixing unit according to an aspect of the invention. As shown in FIG. 2, the apparatus for controlling a fixing unit according includes a power input unit 200, a power supply unit 210, a waveform detection unit 220, an operation control unit 230, and a fixing unit 240.

The power input unit 200 is typically a power cord, and an AC voltage input through the power input unit 200 is output to each of the power supply unit 210 and the waveform detection unit 220.

The power supply unit 210 is a power supply apparatus for generating a variety of voltages required for a printer, and provides power to the fixing unit 240 as will be explained in detail below.

The waveform detection unit 220 detects a point at which the level of the AC voltage input from the power input unit 200 is "0". Whenever the level of the AC voltage becomes "0", the waveform detection unit 220 generates a zero crossing signal (ZCS). The waveform detection unit 220 outputs the generated zero crossing signal to the operation control unit 230.

The operation control unit 230 receives the zero crossing signal from the waveform detection unit 220, generates a control pulse signal for controlling the fixing unit 240 each time the zero crossing signal is received, and outputs the generated control pulse signal to the fixing unit 240.

Figure 3:
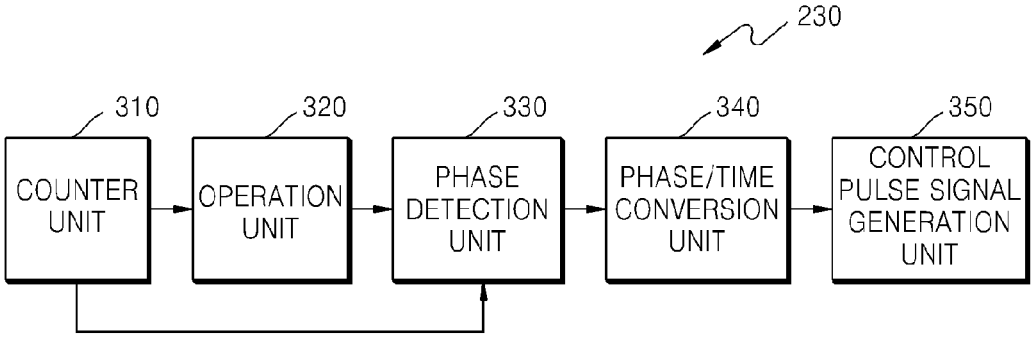
FIG. 3 is a detailed block diagram of an operation control unit shown in FIG. 2 according to an aspect of the invention.

FIG. 3 is a detailed block diagram of the operation control unit 230 shown in FIG. 2 according to an aspect of the invention.

A process performed in the operation control unit 230 shown in FIG. 2 will now be explained in more detail with reference to FIG. 3.

The operation control unit 230 shown in FIG. 3 includes a counter unit 310, an operation unit 320, a phase detection unit 330, a phase/time conversion unit 340, and a control pulse signal generation unit 350.

The counter unit 310 receives the zero crossing signal from the waveform detection unit 220 shown in FIG. 2. The counter unit 310 counts the number of times the zero crossing signal is input to the counter unit 310, and stores the counted number in a count variable (N). That is, when a zero crossing signal is input for the first time, the counter unit 310 stores "1" in the count variable (N). After the zero crossing signal has been input for the first time, if another zero crossing signal is input, the count value is increased by "1" and the increased count value is stored in the count variable (N). Accordingly, the count variable (N) increases by 1 each time a zero crossing signal is input. Also, whenever a zero crossing signal is input, the counter unit 310 measures the time at which the zero crossing signal is input. The measured time is matched with the count variable (N) and stored. The counter unit 310 outputs the stored count variable (N) and the stored input time that was matched with the count variable (N) to the operation unit 320.

The operation unit 320 calculates a half cycle of an AC voltage waveform of the AC voltage from the count variable (N) and the input time that was matched with the count variable (N) that are input from the counter unit 310. That is, the operation unit 320 calculates the half cycle of the AC voltage waveform by taking the difference between the input time of the zero crossing signal corresponding to the count variable (N) when the count variable (N) becomes "2" and the input time of the zero crossing signal corresponding to the count variable (N) when the count variable (N) becomes "1". This is because the half cycle of the AC voltage waveform corresponds to a time interval between two successive times when zero crossing signals are generated.

The phase detection unit 330 receives the calculated half cycle of the AC voltage waveform from the operation unit 320, and receives the count variable (N) from the counter unit 310. The phase detection unit 330 detects phases that are to be a basis for generating control pulse signals based on the calculated half cycle of the AC voltage waveform, the count variable (N), and an predetermined entire phase control time. In this case, the control pulse signals are used for controlling the time that the AC voltage provided to a fixing unit is applied to a heating element of the fixing unit. The entire phase control time means an entire time during which the time that the AC voltage is applied to the heating element of the fixing unit is controlled.

Figure 4:
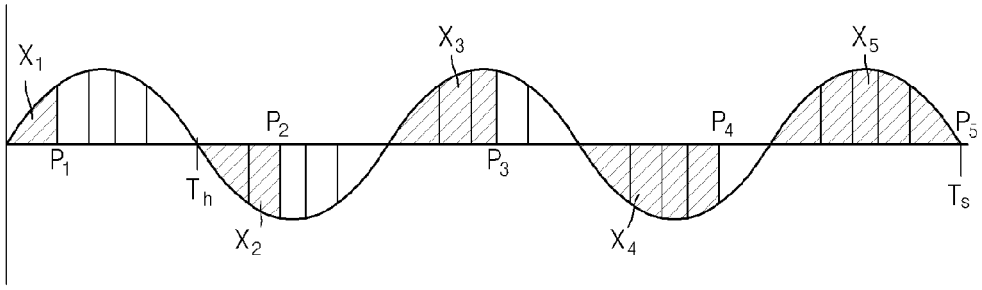
FIG. 4 is a graph of characteristics of phases detected by the operation unit shown in FIG. 3 according to an aspect of the invention.

FIG. 4 is a graph of characteristics of phases detected by the operation unit shown in FIG. 3 according to an aspect of the invention.

A process performed in the phase detection unit 330 shown in FIG. 3 will now be explained with reference to FIG. 4. As shown in FIG. 4, when an area surrounded by a waveform corresponding to a half cycle of an AC voltage waveform is divided into a predetermined number of equal areas, the phase detection unit 330 shown in FIG. 3 detects phases (P1, P2, P3, P4, P5) that divide the area surrounded by the waveform corresponding to the half cycle of the AC voltage waveform into a predetermined number of equal areas. The predetermined number of equal areas is determined from the relationship between the entire phase control time (Ts) and the half cycle (Th) of the AC voltage waveform. That is, if the entire phase control time (Ts) is five times the half cycle (Th) of the AC voltage waveform as shown in FIG. 4, five waveforms each corresponding to the half cycle (Th) of the AC voltage waveform are combined to form the entire phase control time (Ts), and therefore the predetermined number of equal areas is determined to be five. Accordingly, when the waveform corresponding to the half cycle of the AC voltage waveform is divided into five equal areas, the phase detection unit 330 detects five phases (P1, P2, P3, P4, P5) corresponding to each of the five equal areas. First, areas that are integer multiples of one of the equal areas can be obtained using Equation 1 below.

$$x_n = \frac{T_h}{T_s} * (N-1) * \int_0^{T_h=\pi} \sin(x)\,dx = \int_0^{P_n} \cos(x)\,dx \rightarrow \frac{T_h}{T_s} * (N-1) * 2 = -\cos(P_n) + 1 \quad (1)$$

Here, Xn is an area of an integer multiple of one of the equal areas, Ts is the entire phase control time, Th is the half cycle of the AC voltage waveform, N is the counted value of a zero crossing signal, and Pn is a phase corresponding to Xn.

As can be seen from FIG. 4, Pn is a phase at which the integral of the half cycle of the AC voltage waveform from a beginning phase (e.g., zero as shown in FIG. 4) to the phase Pn is equal to Xn, i.e., is equal to the integer multiple of one of the equal areas. For example, if the predetermined number of equal areas is five, X1 is the area of one of the five equal areas (i.e., an integer multiple of 1), and P1 is a phase at which the integral is equal to X1. X2 is the area of two of the five equal areas (i.e., an integer multiple of 2), and P2 is a phase at which the integral is equal to X2. X3 is the area of three of the five equal areas, and P3 is a phase at which the integral is equal to X3. X4 is the area of four of the five equal areas, and P4 is a phase at which the integral is equal to X4. X5 is the area of five of the five equal areas, and P5 is a phase at which the integral is equal to X5. X5 is also equal to the area surrounded by the waveform corresponding to the half cycle of the AC voltage waveform, which is also the maximum value of Xn.

Since the area of the waveform corresponding to the half cycle of the AC voltage waveform is $$\int_0^{T_h=\pi} \sin(x)\,dx,$$

and the area of the waveform corresponding to the half cycle can be divided into equal areas based on the ratio of the half cycle (Th) of the AC voltage waveform to the entire phase control time (Ts), the areas that are integer multiples of one of the equal areas can be calculated using Equation 1. Since the areas that are integer multiples of one of the equal areas increase by an identical amount, i.e., the area of one of the equal areas, the areas are proportional to the counted value (N) of the zero crossing signal.

Phases corresponding to the areas that are integer multiples of one of the equal areas can be detected using Equation 2 below, which is derived from Equation 1. Accordingly, when the waveform corresponding to the half cycle of the AC voltage waveform is divided into five equal areas, five phases (P1, P2, P3, P4, P5) corresponding to the five areas (X1, X2, X3, X4, X5) that area integer multiples of one of the equal areas can be detected using Equation 2.

$$\cos(P_n) = 1 - \frac{2T_h}{T_s} * (N-1) \quad (2)$$

$$\therefore P_n = \cos^{-1}\left\{1 - \frac{2T_h}{T_s}(N-1)\right\}$$

Here, Pn is a phase corresponding to the area that is an integer multiple of one of the equal areas, Ts is the entire phase control time, Th is the half cycle of the AC voltage waveform, and N is the counted value of the zero crossing signal.

Thus, by using Equations 1 and 2, the phase detection unit 330 can detect the phases used for generating control pulse signals.

The phase/time conversion unit 340 receives the detected phases from the phase detection unit 330 and converts the detected phases into times corresponding to the detected phases using Equation 3 below. The converted times (T1, T2, T3, T4, T5) are output to the control pulse signal generation unit 350. Equation 3 is derived from the relationship between phase and time and Equation 2.

$$T_n = \frac{T_h}{\pi} * \cos^{-1}\left\{1 - \frac{2T_h}{T_s}(N-1)\right\} \quad (3)$$

Here, Tn is a time obtained by converting a phase corresponding to an area that is an integer multiple of one of the equal areas into a time, Ts is the entire phase control time, Th is the half cycle of the AC voltage waveform, and N is the counted value of the zero crossing signal.

Equation 3 can be used to calculate Tn directly from Ts, Th, and N without first calculating Pn. However, if Pn has already been calculated using Equation 2, then Tn can be calculated using the simplified Equation 4 below, which is derived by combining Equation 2 and Equation 3 and simplifying.

$$T_n = \frac{T_h}{\pi} * P_n \quad (4)$$

Here, Tn is a time obtained by converting a phase Pn corresponding to an area that is an integer multiple of one of the equal areas into a time, and Th is the half cycle of the AC voltage waveform.

The control pulse signal generation unit 350 receives the times (T1, T2, T3, T4, T5) from the phase/time conversion unit 340, and generates control pulse signals at time points corresponding to each of the times (T1, T2, T3, T4, T5).

Figure 5:
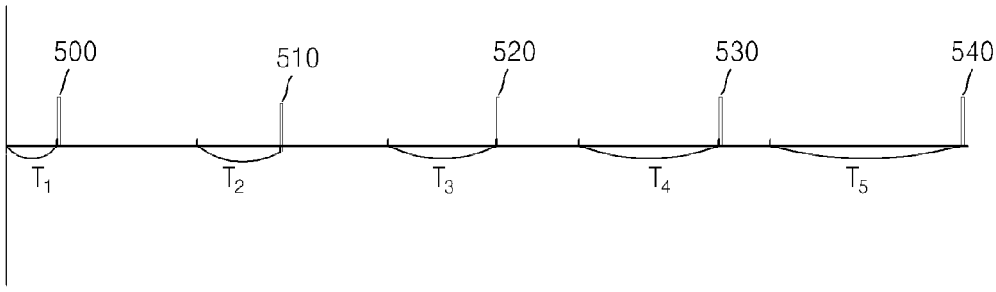
FIG. 5 is a graph of characteristics of control pulse signals generated in a control pulse signal generation unit shown in FIG. 3 according to an aspect of the invention.

FIG. 5 is a graph of characteristics of the control pulse signals generated in the control pulse signal generation unit 350 shown in FIG. 3 according to an aspect of the invention.

Time points for generating the control pulse signals that are generated in the control pulse signal generation unit 350 shown in FIG. 3 will now be explained with reference to FIG. 5.

With reference to the beginning of a half cycle of an AC voltage waveform, i.e., a point where the level of the AC voltage waveform is "0", the control pulse signal generation unit 350 generates control pulse signals 500, 510, 520, 530, and 540 at time points when the times T1, T2, T3, T4, and T5 input from the phase/time conversion unit 340 have elapsed. The control pulse signal generation unit 350 outputs the generated control pulse signals 500, 510, 520, 530, and 540 to the fixing unit 240 shown in FIG. 2.

Referring again to FIG. 2, the fixing unit 240 receives an AC power from the power supply unit 210, and receives the control pulse signals from the operation control unit 230.

Figure 6:
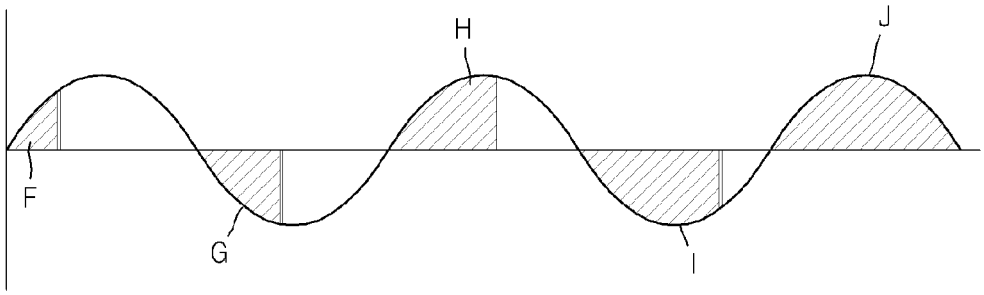
FIG. 6 is a graph of the amount of energy provided to a heating element of a fixing unit according to the control pulse signals shown in FIG. 5 according to an aspect of the invention.

According to the input control pulse signals, the time for providing the AC power to the heating element of the fixing unit 250 is controlled. That is, current flows in the heating element of the fixing unit 240 from the time when the AC voltage waveform corresponding to the half cycle of the AC power begins, i.e., when the level of the AC voltage waveform is "0", only to the time when a control pulse signal is input, so that energy provided to the heating element can be controlled. If the control pulse signals 500, 510, 520, 530, and 540 are provided to the fixing unit 240 at the time points shown in FIG. 5, energy corresponding to the areas F, G, H, I, and J of the waveform shown in FIG. 6 is provided to the heating element of the fixing unit 240. The heating element of the fixing unit 240 is usually a halogen lamp. According to an aspect of the invention shown in FIG. 6, the control pulse signals are used to indicate the ending time of an AC power provided to the heating element of the fixing unit 240. However, according to other aspects of the invention, the control pulse signals can instead be used to indicate the starting time of an AC power provided to the heating element of the fixing unit 240. In such a case, the ending time of the AC power provided to the heating element is the next time the level of the AC voltage waveform is "0".

Figure 7:
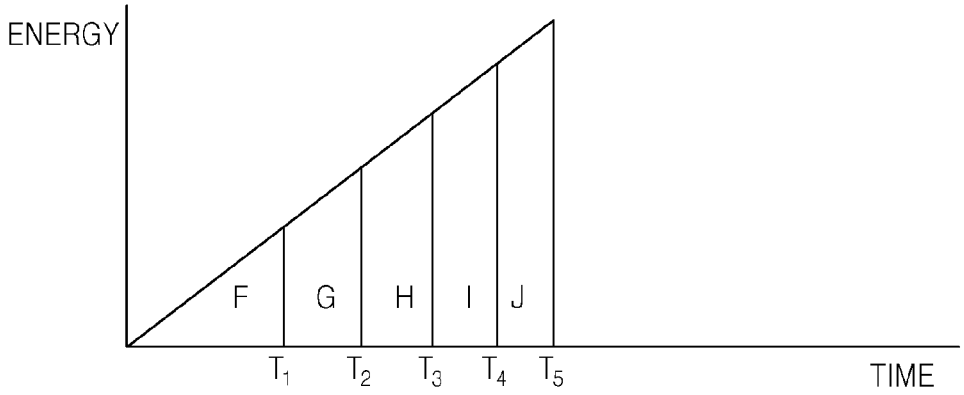
FIG. 7 is a graph of the cumulative amount of energy provided to a heating element of a fixing unit according to an aspect of the invention.

FIG. 7 is a graph of the cumulative amount of energy provided to a heating element of a fixing unit according to an aspect of the invention.

Since the current flowing through the heating element of the fixing unit 240 is controlled by the control pulse signals input from the operation control unit 230, an amount of energy increasing in at a predetermined rate as shown in FIG. 7 is supplied to the heating element. That is, the energy (F, G, H, I, J) supplied to the heating element of the fixing unit 240 corresponding to each of the control pulse signals is identical, and as a result, the changes in the energy supplied to the heating element of the fixing unit 240 are uniform. Accordingly, the distortion of the input voltage and the flicker phenomenon in which power provided to neighboring circuits momentarily flickers due to non-uniform energy changes are substantially reduced or eliminated according to aspects of the invention.

Figure 8:
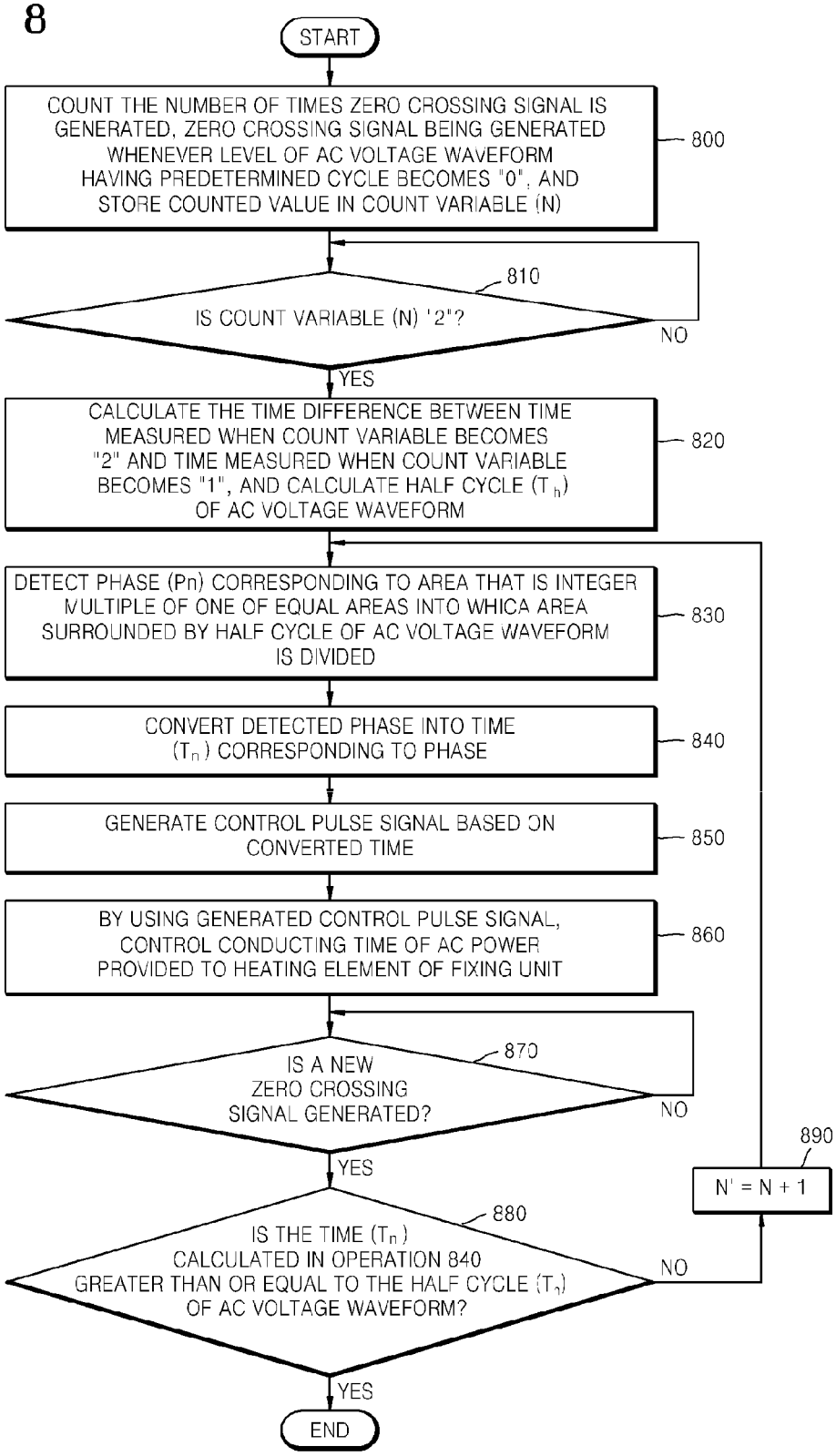
FIG. 8 is a flowchart of a method of controlling the phase of an AC power provided to a fixing unit and a method of controlling a heating element of the fixing unit according to an aspect of the invention.

FIG. 8 is a flowchart of a method of controlling the phase of an AC power having an AC voltage waveform provided to a fixing unit and a method of controlling a heating element of the fixing unit according to an aspect of the invention.

In operation 800, the number of times a zero crossing signal is generated is counted, the zero crossing signal being generated whenever the level of the AC voltage waveform having a predetermined cycle becomes "0", and the counted value is stored in a count variable (N). Also, the time when the zero crossing signal is generated is measured, and the measured time is matched with the count variable (N) and stored.

In operation 810, it is determined whether or not the count variable (N) is "2". That is, it is determined whether or not a second zero crossing signal has been generated, and operation 810 is repeatedly performed until it is determined that the count variable (N) is "2".

In operation 820, the difference between the time measured when the count variable becomes "2" and the time measured when the count variable (N) becomes "1" is calculated, thereby calculating a half cycle (Th) of the AC voltage waveform. This is because the half cycle of the AC voltage waveform corresponds to the time interval between the times when two successive zero crossing signals are generated.

In operation 830, a phase (Pn) corresponding to an area that is an integer multiple of one of a predetermined number of equal areas into which an area surrounded by a waveform corresponding to the half cycle of the AC voltage waveform is divided is detected. Operation 830 may be performed using Equation 2.

In operation 840, the phase (Pn) detected in operation 830 is converted into a time (Tn) corresponding to the detected phase (Pn). Operation 830 may be performed using Equation 3.

In operation 850, a control pulse signal is generated based on the converted time (Tn). That is, since the AC power supplied to the heating element of a fixing unit has the same waveform as the AC voltage waveform having the predetermined cycle, the control pulse signal is generated at a time point when the time (Tn) converted in operation 840 has elapsed from a time point when the level of the AC voltage waveform is "0".

In operation 860, by using the generated control pulse signal, the conducting time of the AC power supplied to the heating element of the fixing unit is controlled. That is, at the time point when the level of the AC voltage waveform is "0", the AC power is controlled to be supplied to the heating element of the fixing unit, and at the time point when the control pulse signal is generated, the AC power is controlled not to be supplied to the heating element of the fixing unit.

In operation 870, it is determined whether or not a new zero crossing signal ha been generated. Operation 870 is repeatedly performed until a new zero crossing signal has been generated. If it is determined that a new zero crossing signal has been generated, operation 880 is performed.

In operation 880, it is determined whether or not the time (Tn) calculated in operation 840 is greater than or equal to the half cycle (Th) of the AC voltage waveform. If the determination result indicates that the time (Tn) is greater than or equal to the half cycle (Th), the controlling procedure is finished. If the determination result indicates that the time (Tn) is not greater than or equal to the half cycle (Th), operation 890 is performed.

In operation 890, the count variable is increased by "1", thereby setting a new count variable. That is, the new count variable (N') is set so that the new count variable (N')=count variable (N)+1. Then, operation 830 is performed.

Aspects of the invention can also be embodied as a computer-readable medium encoded with a computer program or processing instructions for executing or implementing a method of controlling a phase of an alternating current (AC) power according to an aspect of the invention, or a method of controlling a heating element of a fixing unit according to an aspect of the invention. The computer-readable medium may be any data storage device that can store data that can thereafter be read by a computer system, such as read-only memory (ROM), random-access memory (RAM), CD-ROMs, magnetic tapes, floppy disks, and optical data storage devices. Also, aspects of the invention may be embodied as a computer data signal in a carrier wave, or as data transmitted over a network, such as the Internet. The computer-readable medium may also be distributed over network-coupled computer systems so that the computer-readable code is stored and executed in a distributed fashion. Functional programs, code, and code segments for implementing aspects of the invention as computer-readable code can be written by a programmer skilled in the art to which aspects of the invention pertain.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A method of controlling a phase of an alternating current (AC) power having an AC voltage waveform having a predetermined cycle, the method comprising:

counting a number of times a zero crossing signal has been generated, the zero crossing signal being generated whenever a level of the AC voltage waveform becomes "0";

calculating a half cycle of the AC voltage waveform based on times at which the counted number of times the zero crossing signal has been generated changes;

detecting, by using at least one processor, phases that divide an area surrounded by a waveform corresponding to the half cycle of the AC voltage waveform into a predetermined number of equal areas; and generating control pulse signals based on the detected phases;

wherein conducting area of the AC voltage waveform by each of the detected phases increases at a constant rate to increase supplied energy by control of the AC power at a constant rate.

2. The method of claim 1, wherein the calculating of a half cycle of the AC voltage waveform comprises calculating the half cycle by subtracting a time at which the counted number of times the zero crossing signal has been generated becomes "1" from a time at which the counted number of times the zero crossing signal has been generated becomes "2".

3. The method of claim 1, wherein the detecting of the phases comprises detecting the phases based on a predetermined entire phase control time during which the phase of the AC power is to be controlled, the calculated half cycle, and the counted number of times the zero crossing signal has been generated.

4. The method of claim 3, wherein the detecting of the phases comprises:

calculating the area surrounded by the waveform corresponding to the half cycle of the AC voltage waveform by integrating the entire waveform corresponding to the half cycle of the AC voltage waveform;

calculating areas that are integer multiples of one of the equal areas based on the calculated waveform area, the entire phase control time, the calculated half cycle, and the counted number of times the zero crossing signal has been generated; and detecting phases at which integrals of the waveform corresponding to the half cycle of the AC voltage waveform from a beginning phase of the waveform corresponding to the half cycle of the AC voltage waveform to the detected phases are equal to the integer multiples of the one of the equal areas; and wherein a maximum one of the areas that are integer multiples of one of the equal areas is not greater than the calculated waveform area.

5. The method of claim 3, wherein the entire phase control time is an integer multiple of the half cycle of the AC voltage waveform; and wherein the predetermined number of equal areas into which the half cycle of the AC voltage waveform is divided is equal to the entire phase control time divided by the half cycle of the AC voltage waveform.

6. The method of claim 3, wherein the detecting of the phases is performed using the following equation:

$$P_n = \cos^{-1}\left\{1 - \frac{2T_h}{T_s}(N-1)\right\}$$

where Pn is an n-th one of the detected phases, Th is the calculated half cycle, Ts is the entire phase control time, and N is the counted number of times the zero crossing signal has been generated.

7. The method of claim 1, wherein the generating of the control pulse signals based on the detected phases comprises:

converting the detected phases into times corresponding to the detected phases; and generating the control pulse signals at time points when the times corresponding to the detected phases have elapsed from a time point when the level of the AC voltage waveform is "0".

8. The method of claim 7, wherein a maximum one of the times corresponding to the detected phases does not exceed an entire phase control time during which the phase of the AC power is to be controlled.

9. The method of claim 7, wherein the detecting of the phases is performed using the following equation:

$$P_n = \cos^{-1}\left\{1 - \frac{2T_h}{T_s}(N-1)\right\}$$

where Pn is an n-th one of the detected phases, Th is the calculated half cycle, Ts is a predetermined entire phase control time during which the phase of the AC power is to be controlled, and N is the counted number of times the zero crossing signal has been generated; and wherein the converting of the detected phases into times corresponding to the detected phases is performed using the following equation:

$$T_n = \frac{T_h}{\pi} * P_n$$

where Tn is an n-th one of the times corresponding to the detected phases.

10. A non-transitory computer-readable medium encoded with a computer program for executing the method of claim 1 with a computer.

11. A method of controlling a heating element of a fixing unit, the method comprising:

counting a number of times a zero crossing signal has been generated, the zero crossing signal being generated whenever a level of an alternating current (AC) voltage waveform having a predetermined cycle becomes "0";

calculating a half cycle of the AC voltage waveform based on times at which the counted number of times the zero crossing signal has been generated changes;

detecting, by using at least one processor, phases that divide an area surrounded by a waveform corresponding to the half cycle of the AC voltage waveform into a predetermined number of equal areas;

generating control pulse signals based on the detected phases; and controlling a conducting time of an AC power supplied to the heating element of the fixing unit using the generated control pulse signals;

wherein conducting area of the AC voltage waveform by each of the detected phases increases at a constant rate to increase energy supplied to the heating element at a constant rate.

12. The method of claim 11, wherein the detecting of the phases comprises detecting the phases based on a predetermined entire phase control time during which the conducting time of the AC power is to be controlled, the calculated half cycle, and the counted number of times the zero crossing signal has been generated.

13. The method of claim 11, wherein the controlling of the conducting time of the AC power comprises controlling the conducting time so that the AC power supplied to the heating element of the fixing unit is supplied beginning at time points when the level of the AC voltage waveform is "0", and ending at time points when the control pulse signals are generated.

14. A non-transitory computer-readable medium encoded with a computer program for executing the method of claim 11 with a computer.

* * * * *